United States Patent [19]

Stevenson

[11] 4,273,258

[45] Jun. 16, 1981

[54] TOOTH PASTE DISPENSER

[76] Inventor: Charlene Stevenson, 752 NE. 83, Oklahoma City, Okla. 73114

[21] Appl. No.: 20,379

[22] Filed: Mar. 14, 1979

[51] Int. Cl.[3] ..... B65D 35/28

[52] U.S. Cl. ..... 222/103; 222/105

[58] Field of Search ..... 222/95, 101, 102, 103, 222/105

[56] References Cited

U.S. PATENT DOCUMENTS

| | | |
|---|---|---|
| 1,742,536 | 1/1930 | Hausberg . |
| 1,799,678 | 4/1931 | Devlin . |
| 2,026,864 | 1/1936 | Cairns . |

FOREIGN PATENT DOCUMENTS

| | | | |
|---|---|---|---|
| 590548 | 1/1934 | Fed. Rep. of Germany | 222/101 |

*Primary Examiner*—David A. Scherbel
*Assistant Examiner*—Edward M. Wacyra
*Attorney, Agent, or Firm*—Robert K. Rhea

[57] ABSTRACT

A horizontally disposed base supports a collapsible tube filled with tooth paste. A frame, pivotally supported by the base, includes a pressure foot movable toward and away from the collapsible tube in overlying relation for progressively collapsing the tube and extruding paste therein.

4 Claims, 3 Drawing Figures

TOOTH PASTE DISPENSER

BACKGROUND OF THE INVENTION

1. Field of the Invention

The present invention relates to collapsible tube supports and more particularly to a tooth paste dispenser.

Prior patents, such as U.S. Pat. Nos. 1,742,536; 1,799,678 and 2,026,864 have generally disclosed collapsible tube holders which places the paste contained by the tube under pressure with the paste being released by valve means opening and closing the ejection end of the tube.

This invention is distinctive over prior art patents by eliminatng the valve or tube closure means and in which the contents of the tube is placed under pressure sufficient to eject only a desired quantity of the paste.

SUMMARY OF THE INVENTION

A horizontally disposed rectangular flat base is transversely provided with an elongated semicircular in transverse section recess for nestng a peripheral portion of a collapsible tube having a charge of tooth paste therein with the dispensing nozzle of the tube overlying one side edge of the base. A generally U-shaped frame, having telescoping spring biased apart legs, hingedly connected adjacent the said one side edge of the base, is vertically movable about the horizontal hinge axis toward and away from the collapsible tube. The bright portion of the U-shaped frame is provided with a pressure foot member, having an arcuate surface formed on a radius complemental with the radius of the base recess, overlying the tube when the frame is manually pivoted toward the base for extruding paste from the tube in response to pressure manually applied to the frame. The frame legs are telescopically movable toward the hingedly connected end of the frame legs for progressively collapsing the tube and dispensing all of the paste therein.

The principal object of this invention is to provide a relatively simple, easily constructed holder for a collapsible tube and progressively dispensing paste contained thereby.

DESCRIPTION OF THE PREFERRED EMBODIMENT

Figure 1:
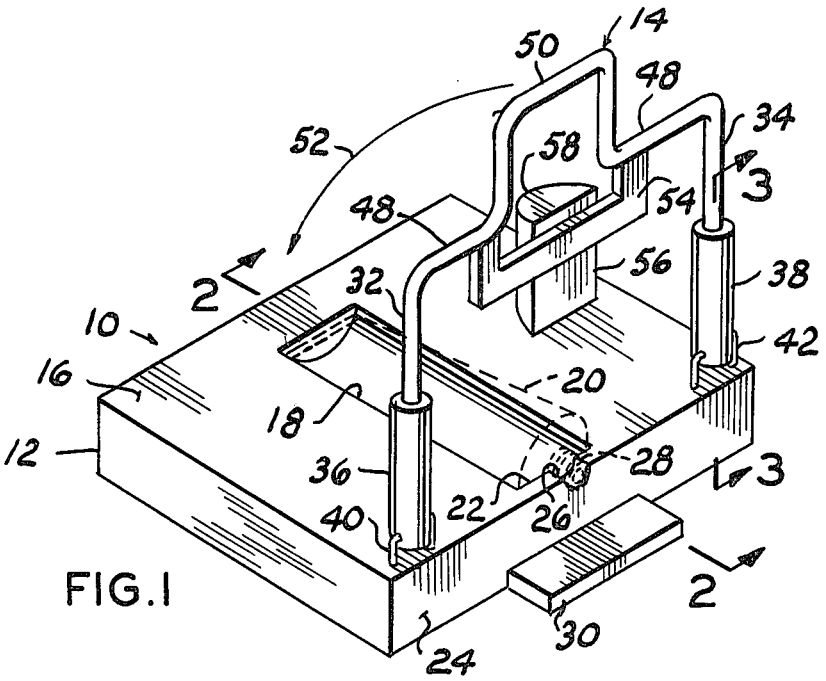
FIG. 1 is a perspective view of the device illustrating, by dotted lines, the relative position of a collapsible tube supported thereby.

Like characters of reference designate like parts in those figures of the drawings in which they occur.

In the drawings:

The reference numeral 10 indicates the device, as a whole, which is rectangular flat-like in general configuration comprising a base 12 normally overlying a horizontal surface 13 and having frame means 14 hingedly connected with the base. In the example shown, the base 12 is rectangular flat-like but may be of other marginal configurations, if desired. The upper surface 16 of the base is provided with an elongated transversely arcuate recess 18 formed on a radius complemental with the periphery of a conventional paste filled collapsible tube 20. The recess 18 terminates in an abrupt shoulder 22 adjacent one side surface 24 of the base for the purpose believed readily apparent.

The base upper surface 16, in that area between the recess shoulder 22 and base side surface 24, is provided with an arcuate recess 26 for nesting a peripheral portion of the collapsible tube discharged nozzle 28. A planar platform 30 is secured to the base edge surface 24 below the position of the tube nozzle 28 for receiving any paste drippings inadvertently squeezed out of the tube.

The frame means 14 comprises a rod-like generally U-shaped member having parallel legs 32 and 34 telescopically received by a pair of casings 36 and 38 in turn hingedly connected by their end portions opposite the frame legs by hinge means 40 and 42 secured to the base adjacent its side edge surface 24 and adjacent the respective ends of the base.

Figure 3:
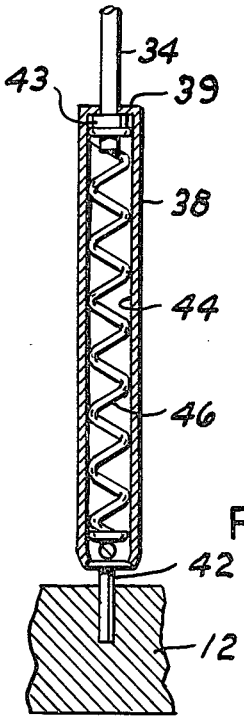

As illustrated by FIG. 3, each of the casings 36 and 38 are provided with a centrally bored closed end 39 through which the respective frame leg projects. A collar 43 is secured to the leg within the casing and is vertically slidable longitudinally of the casing bore 44 toward and away from the respective hinge means. A helical spring 46 is interposed between the hinge means and the collar 42 for normally urging the frame legs toward a telescopically extended position.

Intermediate its ends, the bright portion 48 of the frame is arcuately bent outwardly in the plane of the frame legs to form a generally U-shaped handle portion 50 for vertical pivoting movement of the frame means 14 about the horizontal axis formed by the hinge means 40 and 42 toward and away from the upper surface 16 of the base, as indicated by the arrow 52. A cross member 54 is connected with the frame bight portions 48 in the plane of the frame. An elongated pressure foot member 56, semicircular in transverse section, is connected with the cross member 54 medially its end in longitudinal alignment with the longitudinal axis of the base recess 18. The arcuate surface 58 of the foot is preferably formed on a radius complemental with the radius of the base recess 18 for the purposes presently apparent.

OPERATION

Figure 2:
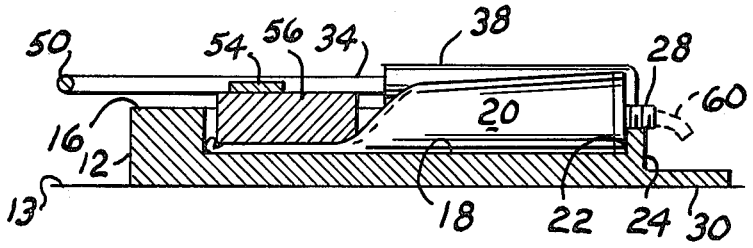
FIG. 2 is a vertical cross sectional view taken substantially along the line 2—2 of FIG. 1 when the frame is pivoted toward the base in a paste dispensing action; and, FIG. 3 is a fragmentary vertical cross sectional view, to a larger scale, taken substantially along the line 3—3 of FIG. 1.

In operation, the tooth paste filled collapsible tube 20 is longitudinally disposed within the recess 18 with its nozzle 28 nested by the recess 26 and with the nozzle cap, not shown, removed. The handle 50 is manually grasped and moved in the direction of the arrow 52 so that the foot member 56 overlies the closed end portion of the collapsible tube 20. Pressure manually applied to the handle 50 extrudes tooth paste 60 through the nozzle 28 onto bristles of a toothbrush, not shown, when disposed below the nozzle 28. By trial and error the user determines the magnitude of pressure to be applied to the handle 50 necessary for dispensing only a desired quantity of the tube paste 60. After the tube 20 has been collapsed and paste dispensed to the position illustrated by FIG. 2, subsequent pivoting movement of the frame means 14 to further collapse the tube 20 is achieved by manually telescoping the frame legs 32 and 34 into the casings 36 and 38 which disposes the foot member 56 toward the nozzle end of the collapsible tube 20.

Obviously the invention is susceptible to changes or alterations without defeating its practicability. Therefore, I do not wish to be confined to the preferred embodiment shown in the drawings and described herein.

I claim:

1. In a holder for a collapsible tube containing paste material and having a discharge nozzle, the improvement comprising:

a base having an upper surface provided with an elongated transversely arcuate recess for nesting a longitudinal peripheral portion of said tube with its nozzle overhanging one side edge surface of said base;

frame means hingedly connected with said base adjacent said one side edge surface for vertical movement about a horizontal axis toward and away from said tube, said frame means including a generally U-shaped member having a bight portion and parallel legs, a pair of casings telescopically receiving one end portion of said legs, and, springs normally biasing said legs toward a telescopically extended position; and, pressure foot means supported by said frame means for extruding paste through said nozzle.

2. The combination according to claim 1 in which said frame means further includes:

a cross member connected with said frame bight portion in the plane of said legs for supporting said pressure foot means.

3. The combination according to claim 2 in which said pressure foot means comprises:

an elongated foot member longitudinally aligned with the base recess, said foot member having an arcuate surface facing said base and formed on a radius complemental with the radius of the base recess.

4. The combination according to claim 3 in which the frame bight portion is deformed medially its ends to form a handle.

* * * * *